US010753069B1

(12) United States Patent
Mourlam et al.

(10) Patent No.: US 10,753,069 B1
(45) Date of Patent: Aug. 25, 2020

(54) DIGGER SHIFT PRIMING

(71) Applicant: Altec Industries, Inc., Birmingham, AL (US)

(72) Inventors: Timothy J. Mourlam, Kansas City, KS (US); David Barnard, Stewartsville, MO (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 16/715,684

(22) Filed: Dec. 16, 2019

(51) Int. Cl.
*E02F 9/22* (2006.01)

(52) U.S. Cl.
CPC ..... *E02F 9/2228* (2013.01); *E02F 9/2267* (2013.01); *E02F 9/2203* (2013.01)

(58) Field of Classification Search
CPC combination set(s) only.
See application file for complete search history.

(56) References Cited

U.S. PATENT DOCUMENTS 4,122,678 A * 10/1978 Wilson ..... E02F 9/2004 60/571
5,329,767 A * 7/1994 Hewett ..... E02F 9/2221 60/414
9,897,112 B2 * 2/2018 Gomm ..... F15B 11/003
2004/0154290 A1 * 8/2004 Kruppa ..... B66C 13/18 60/325

FOREIGN PATENT DOCUMENTS

EP 0558765 A1 9/1993

* cited by examiner

*Primary Examiner* — Kidest Bahta
(74) *Attorney, Agent, or Firm* — Erise IP, P.A.

(57) ABSTRACT

A system and method for automatically adjusting a pressure within a variable volume of a hydraulic feed tube while the variable volume of the hydraulic feed tube is changing. Inputs are used to determine the appropriate pressure adjustments for the hydraulic feed tube, which is adjusted by a pressure reducing valve, wherein control of the pressure reducing valve is updated continuously by a control module.

20 Claims, 7 Drawing Sheets

DIGGER SHIFT PRIMING

BACKGROUND

1. Field

Embodiments of the invention relate to the hydraulic components of utility vehicles. More specifically, embodiments of the invention relate to maintaining hydraulic tube pressure as hydraulic tube volume changes.

2. Related Art

Utility workers utilize vehicles having hydraulic components, for example, a utility vehicle with a boom assembly including a boom. The boom assembly may rely on hydraulic components to extend and retract the boom. Boom assemblies are typically equipped with various additional functional components or accessory devices, such as a digger assembly. A utility vehicle with a digger assembly is typically known as a digger derrick. The additional functional components and accessory devices may also rely on hydraulic power input. A digger assembly may utilize a digger motor to convert hydraulic power into rotational power to perform digging operations. In circumstances where the digger assembly is attached to a distal end of the boom, the volume of a hydraulic feed tube that supplies the hydraulic power may vary with extension of the boom. The variable volume poses a control issue when it comes to providing appropriate levels of hydraulic power to the digger assembly at various boom extension positions. The volume change may affect the pressure within hydraulic feed tubes of the boom. A specific hydraulic feed tube may be used to shift the digger assembly, which may rely on the pressure in the hydraulic feed tube to convey a shift signal. Because the pressure is affected by the volume change, it may be difficult to maintain the pressure to shift the digger assembly. If the digger motor is operated while shifting, gears within a gearbox of the digger assembly may grind potentially leading to digger gearbox failure.

Typically, to prevent grinding of the gears within the digger gearbox, the operator of the digger is supposed to wait until the digger assembly has finished shifting before engaging the motor. Shifting the digger assembly may take around 2 seconds when the boom is fully retracted and may take over 10 seconds when the boom is fully extended. The reason the shifting time for a fully extended boom is increased is because the hydraulic feed tube that supplies the pressure signal to shift the digger speed is also extended and the volume is increased. The hydraulic feed tube may draw a vacuum due to the increased volume associated with the extension. The hydraulic feed tube is then supplied with hydraulic fluid to overcome the vacuum and reach the pressure level requested for the hydraulic feed tube to shift the digger speed. The process of supplying hydraulic fluid to an extended hydraulic feed tube may take a relatively long time. The variable, and in some cases lengthy, wait times associated with filling the hydraulic feed tube with hydraulic fluid render the system prone to human error. For instance, the operator may not wait long enough and engage the motor, putting the system at risk of gearbox failure, which can be costly and lead to downtime on digger projects.

Current methods of avoiding the grinding of gears in the gearbox of the digger motor include software time-delays or lockouts that restrict device output, such as activation of the digger motor, for a predetermined period of time or repress operator input. Unfortunately, these delays and lockout mechanisms force the operator to wait, which in some cases, leads the operator to believe that a component within the device is broken. Further, the current methods of delays and lockout mechanisms interfere with the operator's work, as the operator may have to stop working and wait for the delay or lockout to pass.

Another problem encountered by utility workers when operating utility vehicles having a boom assembly and a digger assembly is inadvertent shifts of the digger motor. These shifts can be caused by pressure build up within the digger shift hydraulic feed tube associated with the retraction of the boom. In certain cases, the pressure that is created from the decrease in variable volume becomes significant enough to shift the digger speed inadvertently. Inadvertent shifts of the digger can be dangerous and harmful to components of the digger assembly.

SUMMARY

Embodiments of the invention solve the above-mentioned problems by providing a control system to maintain hydraulic tube pressure as hydraulic tube volume changes. In some embodiments, the system receives operator inputs indicative of a change in the hydraulic tube volume (e.g., increase or decrease) and the desired hydraulic tube pressure. The system comprises a control module operable to receive said inputs and control a pressure reducing valve according to the inputs to maintain the desired pressure even when the volume of the hydraulic tube is increasing or decreasing.

A first embodiment of the invention is directed to a system for controlling a pressure in a hydraulic feed tube of a boom assembly, the boom assembly comprising: a boom having a proximal end and a distal end, the hydraulic feed tube disposed within the boom with a first end of the hydraulic feed tube at the proximal end of the boom and a second end of the hydraulic feed tube at the distal end of the boom, wherein the hydraulic feed tube has a variable volume that changes according to a motion state of the hydraulic feed tube, wherein the motion state of the hydraulic feed tube is based on a first operator input, a control module, a pressure valve disposed at the first end of the hydraulic feed tube, and a digger assembly secured to the distal end of the boom, the digger assembly comprising: a digger motor, a gearbox disposed proximate to the digger motor to translate rotational motion of the digger motor to a driven shaft, and an auger secured to the driven shaft, wherein a pressure within the variable volume is associated with a shift state of the digger assembly, wherein the shift state of the digger assembly is based on a second operator input, wherein the control module is programmed to control the pressure valve to adjust the pressure within the variable volume of the hydraulic feed tube according to the motion state of the hydraulic feed tube and the shift state of the digger assembly, wherein the pressure within the variable volume of the hydraulic feed tube is adjusted while the variable volume is changing.

A second embodiment of the invention is directed to a method for maintaining a pressure within a hydraulic feed tube of a boom assembly comprising the steps of: receiving, from an operator, a first input associated with a motion state of the hydraulic feed tube, wherein a variable volume of the hydraulic feed tube changes according to the motion state of the hydraulic feed tube, receiving, from the operator, a second input associated with the pressure, adjusting a pressure valve according to the motion state of the hydraulic feed tube to maintain the pressure within the variable volume while the variable volume is changing, and continuously updating a command to control the adjustment of the pressure valve based at least in part on the first operator input and the second operator input.

A third embodiment of the invention is directed to one or more non-transitory computer readable media storing computer-executable instructions that, when executed by a processor, perform a method of maintaining a pressure within a hydraulic feed tube of a boom assembly comprising the steps of: receiving, from an operator, a first input associated with a motion state of the hydraulic feed tube, wherein a variable volume of the hydraulic feed tube is changed according to the motion state of the hydraulic feed tube, receiving, from an operator, a second input associated with the specified pressure, adjusting a pressure valve according to the motion state of the hydraulic feed tube to maintain the pressure within the variable volume while the variable volume is changing, and continuously updating a command to control the adjustment of the pressure valve based at least in part on the first input and the second input.

Additional embodiments of the invention are directed to a utility vehicle having a boom assembly and a digger assembly. The boom assembly comprising a hydraulic feed tube that may be extended or retracted along with sections of the boom. The hydraulic feed tube may be operable to control the shift state of a digger assembly via a pressure signal from a proportional pressure reducing valve controlled by an electronic control module.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1A:
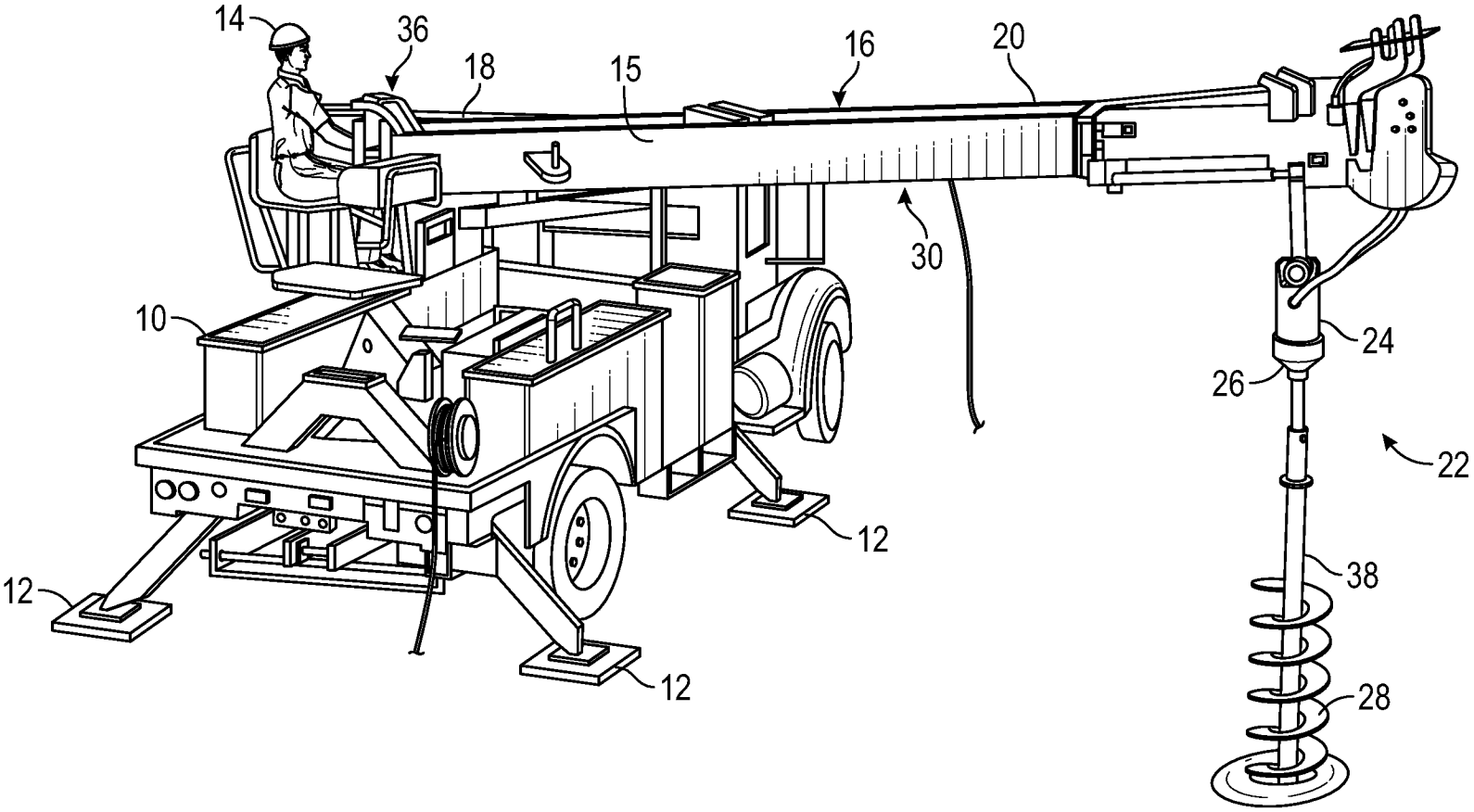
FIG. 1A is a depiction of a digger derrick utility vehicle pertaining to some embodiments of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

In some embodiments, hydraulic power is used to extend and retract a boom, shift a digger assembly speed, and operate a digger motor, as well as various other functions. The pressure of hydraulic feed tubes may be controlled by an electronic control module, which uses an algorithm to set a proportional pressure reducing valve according to a plurality of operator inputs. The operator inputs may include a request for extension or retraction of the boom, as well as a desired digger shift state. The system may use the proportional pressure reducing valve to adjust a hydraulic pressure in a digger shift hydraulic circuit according to the output of the electronic control module, which accounts for the variable volume associated with the state of the boom. When the boom is extended the variable volume may be larger and therefore require a greater pressure to yield the same effect as for a smaller volume associated with a retracted boom. The volume difference is noticed when shifting the speed of the digger.

The pressure reducing valve reduces the pressure within the hydraulic feed tube to a preset level downstream of the valve. The preset value may be adjusted based on an electrical signal received from the control module. In some embodiments, the pressure reducing valve may be an electro-proportional pressure reducing valve (EPRV), which is controlled by an electronic signal received from the control module.

FIG. 1A presents an exemplary depiction of a utility vehicle 10 comprising a plurality of outriggers 12 to support the utility vehicle 10 during operation. The utility vehicle 10 is attached to a boom assembly 16. The boom assembly 16 comprises a boom 15 having a proximal end 18 and a distal end 20. The boom 15 may be a telescoping boom configured to extend or retract upon operator input. The boom assembly 16 is attached to the utility vehicle 10 at the proximal end 18. At the distal end 20 of the boom assembly 16 a digger assembly 22 is attached. The digger assembly 22 comprises a digger motor 24, a gearbox 26, a driven shaft 38, and an auger 28. In some embodiments, gearbox 26 comprises a plurality of planetary gears to translate the rotational motion of the digger motor 24 to the driven shaft 38 and auger 28. A plurality of hydraulic feed tubes 30 be disposed internal to the boom 15 at the position indicated.

Figure 1B:
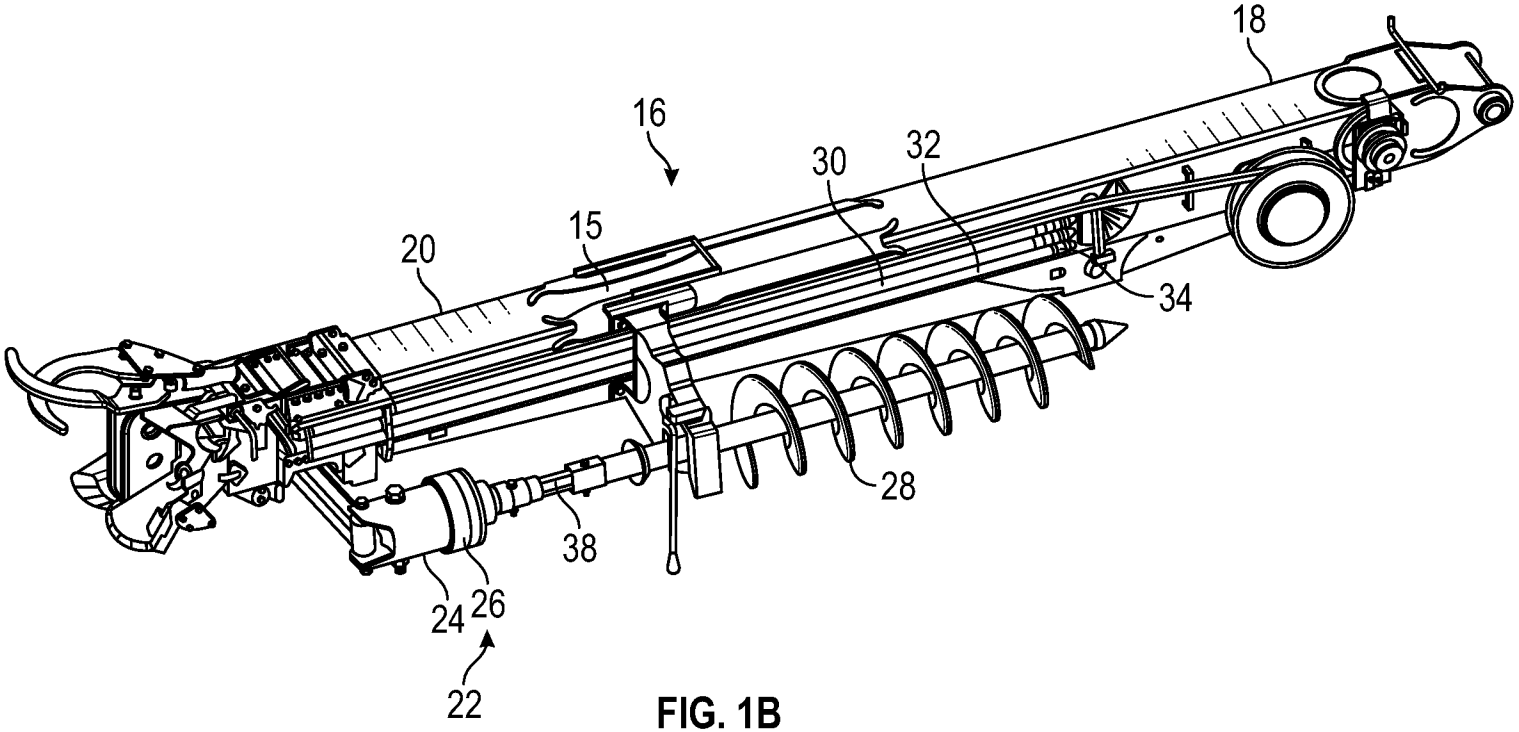
FIG. 1B is a depiction of a boom assembly and a digger assembly pertaining to some embodiments of the invention.

FIG. 1B depicts the boom assembly 16 and the digger assembly 22. The boom assembly 16 comprises the proximal end 18, the distal end 20 of the boom 15, and the plurality of hydraulic feed tubes 30. A specific digger shift hydraulic feed tube 32 of the plurality of hydraulic feed tubes 30 may be devoted to the digger shift hydraulic circuit. The boom assembly 16 may be secured to the utility vehicle 10 or a mounting assembly (not shown) at the proximal end 18. The distal end 20 of the boom assembly 16 may be secured to the digger assembly 22 comprising the digger motor 24, the gearbox 26, the auger 28, and the driven shaft 38.

The digger motor 24 converts energy from a power source into rotational energy. The rotational energy may be translated from the digger motor 24 to the driven shaft 38 through the rotation of gears within gearbox 26. The driven shaft 38 is secured to auger 28 at one end, so when the driven shaft rotates, the auger 28 rotates at the same speed. The auger 28 may be secured to the driven shaft 38 by a screw, weld, or some other fastener means.

To shift the digger speed, a pressure signal may be conveyed through digger shift hydraulic feed tube 32 to the digger assembly 22. In some embodiments, the pressure signal may initiate the shift by means of a hydraulic shift cylinder or a clutch component disposed within or adjacent to the gearbox 26.

In some embodiments, the plurality of hydraulic feed tubes 30 may run along the length of the boom assembly 16 and are utilized to provide hydraulic power to extend/retract the boom assembly 16, run the digger motor 24, and shift the speed of the gearbox 26. At least a portion of the plurality of hydraulic feed tubes 30 may be disposed within the boom 15 or secured to an outside surface of the boom 15. In certain embodiments, the hydraulic feed tubes 30 carry out various other functions not described herein. The specific digger shift hydraulic feed tube 32 may be devoted to the digger shift hydraulic circuit, which controls the shifting of the digger speed via a pressure signal conveyed through the digger shift hydraulic feed tube 32. The pressure within the digger shift hydraulic feed tube 32 may be adjusted by a proportional pressure reducing valve 34. The digger shift hydraulic feed tube 32 may be disposed in the boom assembly 16 and may comprise a first end disposed at the proximal end 18 of the boom 15 and a second end disposed at the distal end 20 of the boom 15. The proportional pressure reducing valve 34 may be disposed at the first end of the digger shift hydraulic feed tube 32. In some embodiments, the proportional pressure reducing valve 34 may be an electro-proportional pressure reducing valve (EPRV). The digger shift hydraulic feed tube 32 may be operable to carry a pressure signal associated with a shift of the digger speed. The digger shift hydraulic feed tube 32 may be connected to a digger shift cylinder of the digger assembly 22 at one end and connected to the proportional pressure reducing valve 34 at another end. The proportional pressure reducing valve 34 may be controlled by an electronic control module 36. The electronic control module 36 may be disposed at the location indicated in FIG. 1A, such as proximate the proximal end of the boom 15. In some embodiments, the electronic control module 36 utilizes an algorithm to determine the proper output signal to be sent to the proportional pressure reducing valve 34 to adjust the pressure within the digger shift hydraulic feed tube 32 according to a plurality of inputs, including an input for the motion state of the boom assembly 16 and an input for the desired digger shift state of the digger assembly 22. The algorithm is discussed in further detail below in reference to FIG. 3.

The digger speed described herein may refer to any one or more of the rotational speed of the auger 28, the rotational speed of the driven shaft 38, and the rotational speed of the digger motor 24. In some embodiments, the digger speed may also refer to a shift state of the digger assembly 22.

Figure 1C:
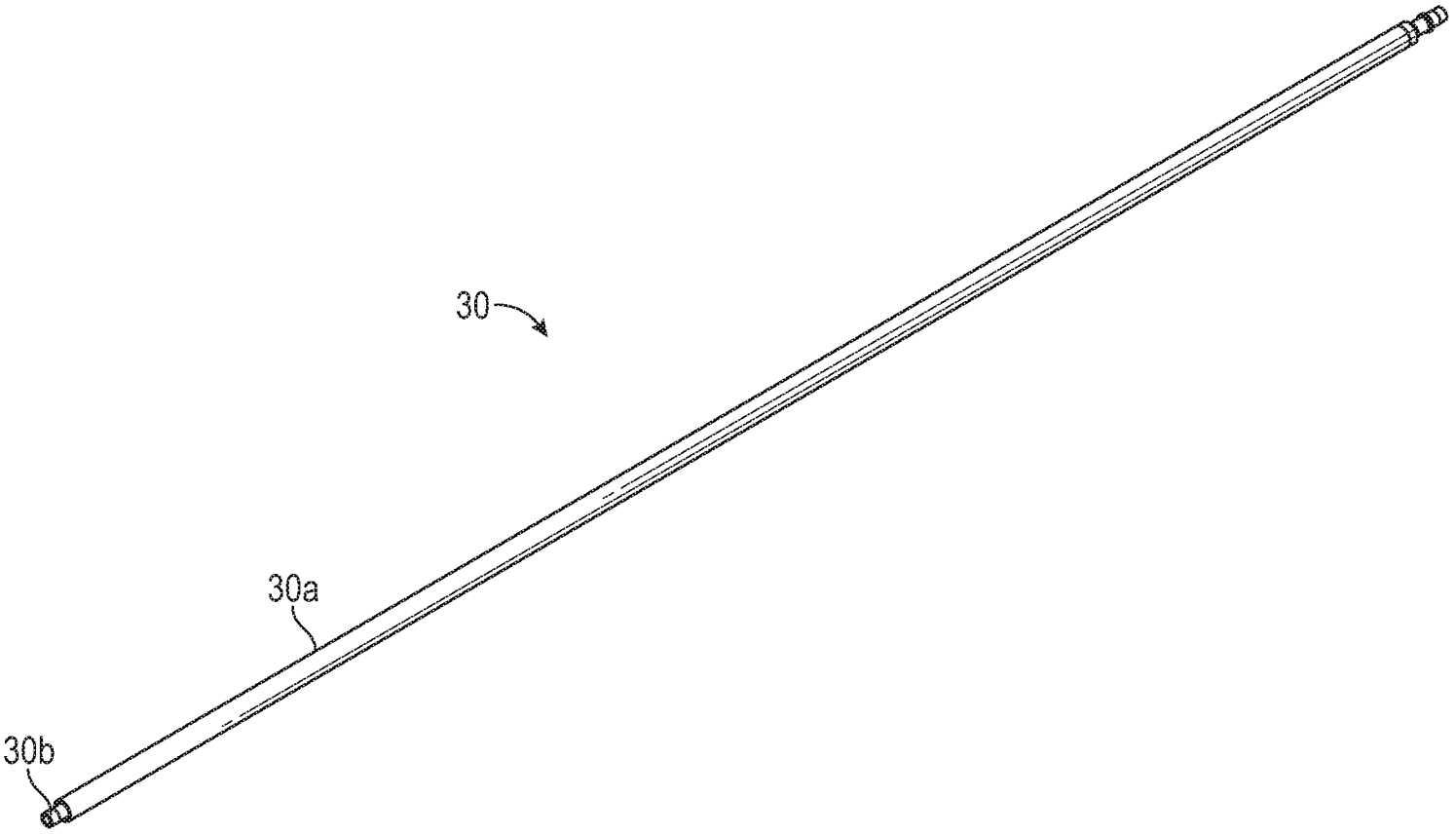
FIG. 1C is a depiction of a hydraulic feed tube used by some embodiments of the invention.

FIG. 1C shows an exemplary hydraulic feed tube 30 of the plurality of hydraulic feed tubes 30. In some embodiments, each of the plurality of hydraulic feed tubes 30 may comprise at least two telescoping tubing sections, namely a first tubing section 30*a* that is substantially cylindrical and a second tubing section 30*b* that is also substantially cylindrical but has a slightly smaller cross section as to fit within the first section. The size of the second tubing section 30*b* of each of the plurality of hydraulic feed tubes 30 may be chosen accordingly to have a sealing fit within the first tubing section 30*a* due to interference between the tubing sections. Interference fit O-rings may also be used in some embodiments to ensure a seal between the tubing sections and may be disposed on the outside of the second tubing section 30*b*. The tubing sections may telescope with extension/retraction of the boom assembly 16. During the motion states (extension/retraction), the volume of the plurality of hydraulic feed tubes 30 will be changed. When the tubing sections are extended, the volume of the plurality of hydraulic feed tubes 30 may increase, and when the tubing sections are retracted the volume of the plurality of hydraulic feed tubes 30 may decrease. It should be understood that in some embodiments the digger shift hydraulic feed tube 32 may be substantially similar to the hydraulic feed tube 30 described in reference to FIG. 1C.

In certain embodiments, the shifting of the planetary gears within the gearbox 26 may be accomplished by receiving a pressure signal that affects a clutch component. The clutch component may be positioned within the gearbox or along an input shaft. The clutch component can be either engaged or disengaged. In some embodiments, a plurality of clutch components may be used with at least one of the clutches positioned within or adjacent to the gears, wherein the pressure signal affects which of the clutches are activated and in turn which gear ratio is used. In such embodiments, the clutches, when engaged, translate rotational motion to the gears. The gear ratio that is used may affect how the rotation of the digger motor 24 is transmitted to a driven shaft 38 of the auger 28 and can be used to control the rotational speed of the auger 28. It may be desirable to adjust the rotation speed of the auger 28 in digger derrick operations as the properties of the ground vary from location to location, or even vertically in a single location. For this reason, it is desirable that the rotational speed of the auger 28 can be adjusted to perform various digging operations across many types of ground. Further, during the stages of operation it may be necessary to shift the digger speed. For instance, a different speed may be used when initially tapping a hole in the ground than when digging in a pre-tapped hole in the ground. In some embodiments, the shift state of the digger assembly 22 may be selected as one of a high-speed setting and a low-speed setting, though some embodiments may include more speed settings, such as, for example, a medium speed setting or an analog speed setting that may be adjusted using an input dial to produce a range of speeds for the digger assembly 22.

In some embodiments, a shift of the digger may be carried out by passing a pressure signal through the digger shift hydraulic feed tube 32 to a shift cylinder. The shift cylinder may be disposed adjacent to the gearbox 26. In certain embodiments, the shift cylinder may shift between a high-speed setting configuration and low-speed configuration, however, the shift cylinder may be adapted to shift between a plurality of speed settings. In embodiments that include a clutch component to transmit rotation to the driven shaft 38 of the digger assembly 22, the shift cylinder may translate the shift signal to the clutch component to engage/disengage the clutch component from the driven shaft 38.

In some embodiments, the control system may run continuously to maintain the pressure within the digger shift hydraulic feed tube 32 for a period of time, by continuously updating the command to the proportional pressure reducing valve 34. Since the control system constantly updates the pressure within the digger shift hydraulic feed tube 32 according to the motion state of the boom assembly 16, the pressure may automatically be updated while the boom 15 is being extended or retracted. This eliminates the need to wait for the digger shift hydraulic feed tube 32 to be filled when a digger shift is initiated after extending the boom 15 because the digger shift hydraulic feed tube 32 is already set to the appropriate pressure according to the state of the boom assembly 16. In certain cases, the system can perform a digger shift in under 2 seconds, even when the boom 15 is fully extended. Accordingly, the system offers an effective solution to the aforementioned problems of long shift times, grinding gears, and inadvertent shifts.

Figure 2:
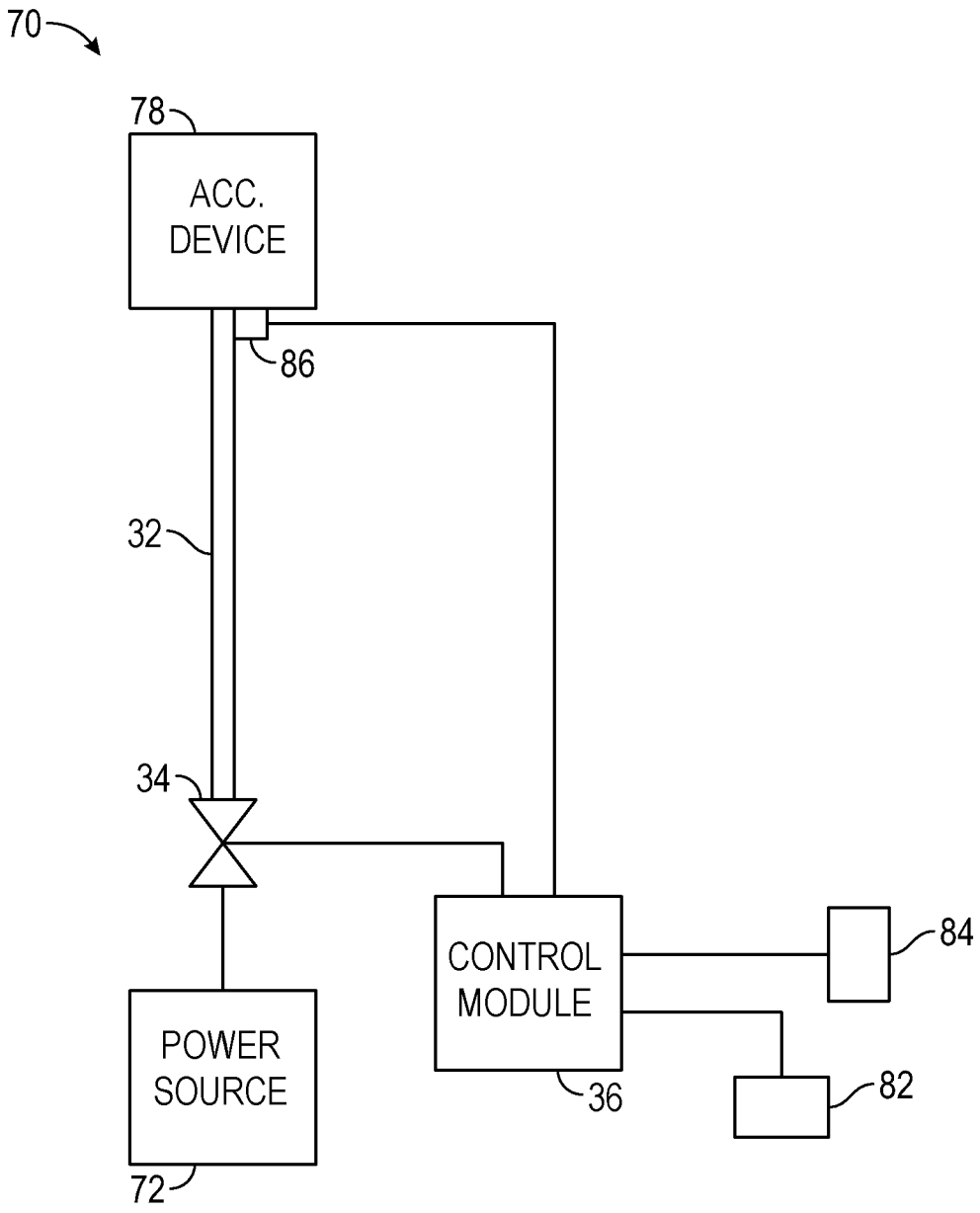
FIG. 2 depicts a variable volume pressure control system that may be used by some embodiments of the invention.

During operation for a particular embodiment, an operator 14 may be positioned on a utility vehicle 10 with a boom assembly 16, the operator 14 having access to a plurality of controls. The plurality of controls may be located on an input device, such as input device 82 as shown in FIG. 2. Specifically, the operator 14 may be able to provide inputs into the electronic control module 36, via the plurality of controls, indicating a desired digger shift state and an extension/retraction state of the boom assembly 16. The electronic control module 36 may use these inputs to determine the appropriate setting of the proportional pressure reducing valve 34. The setting of the proportional pressure reducing valve 34 in turn, controls the digger shift state of the digger assembly 22. For example, if the operator 14 inputs a request for a high-speed digger shift state and full boom extension, the system may set the proportional pressure reducing valve 34 to a high-pressure setting. The high-pressure setting provides a relatively high pressure in the digger shift hydraulic feed tube 32 to overcome the increased volume in the digger shift hydraulic feed tube 32 due to the extension of the boom 15. The high pressure may be used to shift the gears in the gearbox 26 to a high-speed configuration. The variable volume of the digger shift hydraulic feed tube 32 within the telescoping section of the boom 15 may be increased during boom extension and decreased during boom retraction. To maintain the pressure of the digger shift hydraulic feed tube 32 during volume increase, pressure may be added and during volume decrease, pressure may be released. Some embodiments of the invention use the motion state of the variable volume along with the shift state of the digger assembly 22, as inputs into the electronic control module 36. The control module 36 adjusts the proportional pressure reducing pressure valve 34 to change or maintain the pressure within the variable volume according to the inputs. The electronic control module 36 may be programmed to control the adjustment of the proportional pressure reducing valve 34 to automatically add pressure to the variable volume during extension of the digger shift hydraulic feed tube 32 and automatically subtract pressure from the variable volume during retraction of the digger shift hydraulic feed tube 32.

During exemplary operation of the utility vehicle 10 shown in FIG. 1A, an operator 14 may give an operator input to electronic control module 36 to extend the boom assembly 16. While the boom 15 is extending, the electronic control module 36 adjusts the proportional pressure reducing valve 34 based at least in part on the operator input. The proportional pressure reducing valve 34, in the case of boom extension, adds pressure to the variable volume of digger shift digger shift hydraulic feed tube 32. After the boom 15 reaches full extension, the pressure in the digger shift hydraulic feed tube 32 is at a desired level, as set by the proportional pressure reducing valve 34. Accordingly, if the operator 14 requests a shift of the digger assembly 22, the digger shift hydraulic feed tube 32 can apply the desired pressure signal without first having to be filled to account for the increased variable volume. For this reason, the operator 14 does not have to wait and the planetary gears within gearbox 26 are not at risk of being grinded by a premature activation of the digger motor 24.

FIG. 2 shows an exemplary embodiment for implementation in a range of applications. The variable volume pressure control system 70 comprises a plurality of components, including a power source 72, the proportional pressure reducing valve 34, which may be any type of pressure valve, the digger shift hydraulic feed tube 32 which may be any variable volume container, an accessory device 78, the electronic control module 36, which may be any type of control module, an input device 82, and a notification device 84. In some embodiments, the digger shift hydraulic feed tube 32 may not be designated for a shift of the digger assembly 22 but be a variable volume hydraulic feed tube to supply a pressure signal to the accessory device 78. The electronic control module 36 may not be limited to the control of the devices described herein but may be incorporated into a centralized control system that handles various additional functions. In some embodiments, however, the electronic control module 36 may be a designated device that exclusively carries out functions related to the hydraulic system. The power source 72 may be a hydraulic power source that supplies hydraulic power and hydraulic signals to the plurality of hydraulic feed tubes 30, and in some embodiments, interfaces with the proportional pressure reducing valve 34. Proportional pressure reducing valve 34 may be disposed between power source 72 and digger shift hydraulic feed tube 32 which may be a variable volume container. In some embodiments, the proportional pressure reducing valve 34 may be disposed within the variable volume container at an end of the container. The variable volume container may be attached to the accessory device 78 and proportional pressure reducing valve 34 but may be otherwise sealed. Proportional pressure reducing valve 34 may interface with electronic control module 36, which may also be interfaced with the input device 82, and notification device 84. In some embodiments, the input device 82 and notification device 84 may be integrated into a single multifunctional device or may be two separate components. In some embodiments, the input device may be at least one of a control board, a lever, and a button. In some embodiments, the notification device may be at least one of a display, a light, and an audible alarm. The accessory device 78 may be attached at one end of the digger shift hydraulic feed tube 32 while the proportional pressure reducing valve 34 may be disposed at the other end of the digger shift hydraulic feed tube 32. In some embodiments, the accessory device 78 may be any device attached to the end of the digger shift hydraulic feed tube 32, such as, for example, digger assembly 22, the shift cylinder, a hydraulically shifted winch, and a grapple device.

Figure 3:
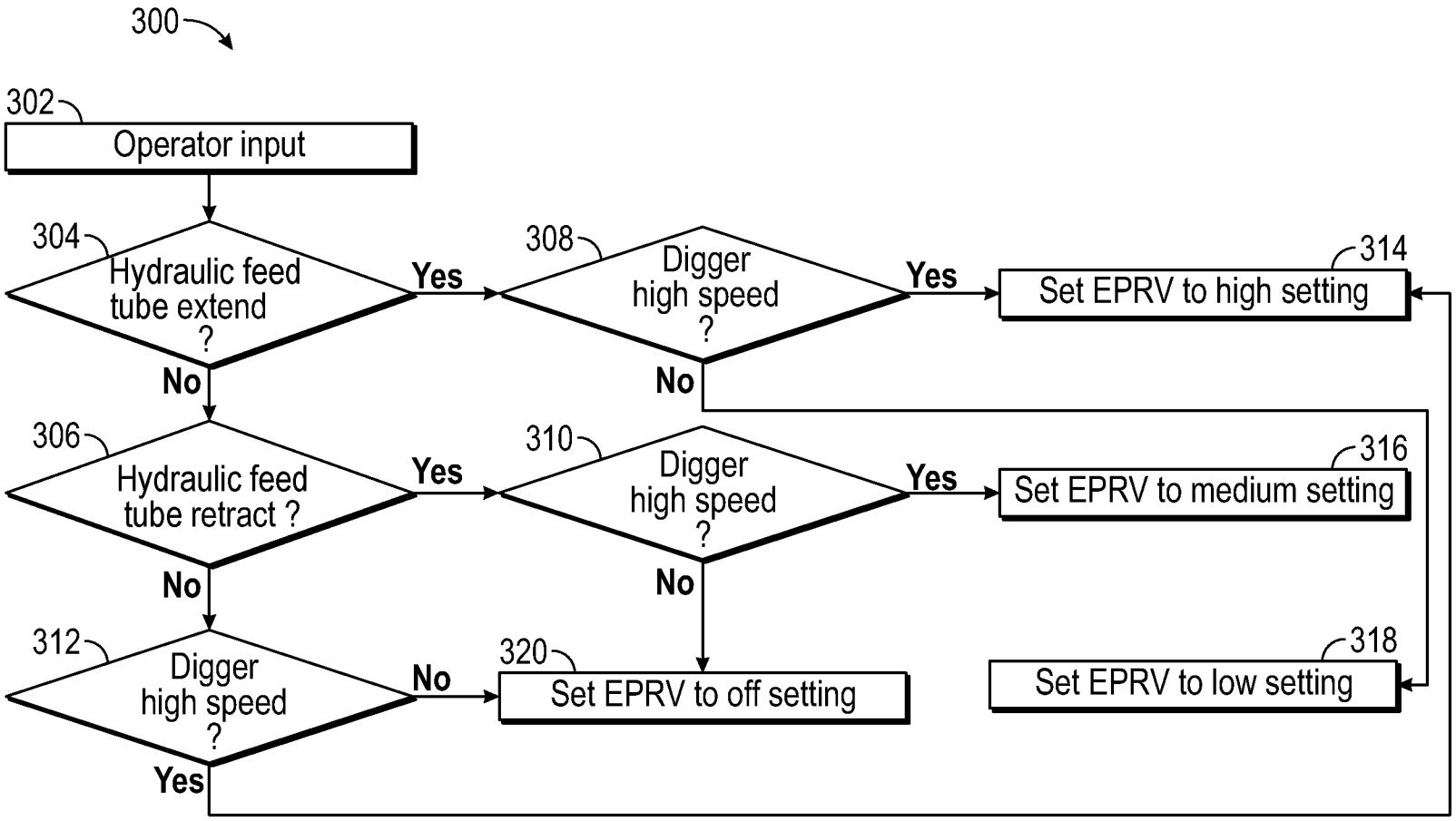
FIG. 3 is an exemplary flow diagram that may be used by some embodiments of the invention.

As further discussed relative to the flow chart of FIG. 3, during operation the variable volume pressure control system 70 of FIG. 2 may be operable to maintain a desired pressure within the digger shift hydraulic feed tube 32 even as the variable volume within the container is changing. The changing of the variable volume may be associated with an increase in the volume or a decrease in the volume. The power source 72 supplies pressure to the proportional pressure reducing valve 34. Proportional pressure reducing valve 34 can be adjusted according to signals received by the proportional pressure reducing valve 34 from the electronic control module 36. These signals may be electrical, hydraulic, mechanical, or any other form of signal. The proportional pressure reducing valve 34 in turn controls the pressure within the digger shift hydraulic feed tube 32. The volume of the variable volume container may be increased or decreased during operation. Inputs to increase or decrease the volume of the digger shift hydraulic feed tube 32 may be received by the input device 82. In some embodiments, the inputs may be instructions to extend or retract the boom 16. Other inputs received by the input device may be instructions to shift the speed of the digger assembly 22 or start the digger motor 24. These inputs may be from an operator 14, or from a measurement device and are communicated to the electronic control module 36 by means of the interface of electronic control module 36 with input device 82. An additional input regarding an adjustment to the value of the desired pressure may also be received by the input device 82, either from an operator 14 or from some other source. The electronic control module 36 may process any inputs from the input device 82 to determine an appropriate signal to send to the proportional pressure reducing valve 34. For this reason, the signal communicated to the proportional pressure reducing valve 34 may be based at least in part on the inputs received by the input device 82. The pressure may then be adjusted accordingly to a desired value in order to reach a desired condition for the accessory device, which may be hydraulically connected to the variable volume. The accessory device may require a specific amount of pressure to perform a specific operation. The described embodiment presents a method by which the specific pressure can be reached and maintained even as the variable volume is increasing or decreasing. Because the command from the electronic control module 36 to the proportional pressure reducing valve 34 may be updated continuously, the pressure within the variable volume may be adjusted while the variable volume is changing.

The digger shift hydraulic feed tube 32 may be any container with a volume that can be increased and decreased, such as, for example, an extendable tube, a bellows, or tube having a plunger mechanism to change the volume within the tube. It is a common issue with any variable volume container that the pressure within the container is inadvertently affected by a change in the volume of the container. The invention presents a method to maintain the pressure of a changing variable volume.

In certain embodiments, the pressure control system 70 may include at least one pressure sensor 86 to monitor a pressure. The pressure sensor 86 may be disposed within the digger shift hydraulic feed tube 32 to measure the pressure within the digger shift hydraulic feed tube 32 and convey a pressure reading to the electronic control module 36. The pressure sensor 86 may be a hydraulic pressure transducer, piezometer, manometer, pressure transmitter, or in systems with a plurality of pressure sensors, multiple types of pressure sensors may be used. In some cases, the pressure reading may be communicated electronically as a digital or analog signal to the control module. The signal received by the electronic control module 36 from the pressure sensor 86 may be used along with operator input to control the proportional pressure reducing valve 34.

Figure 5:
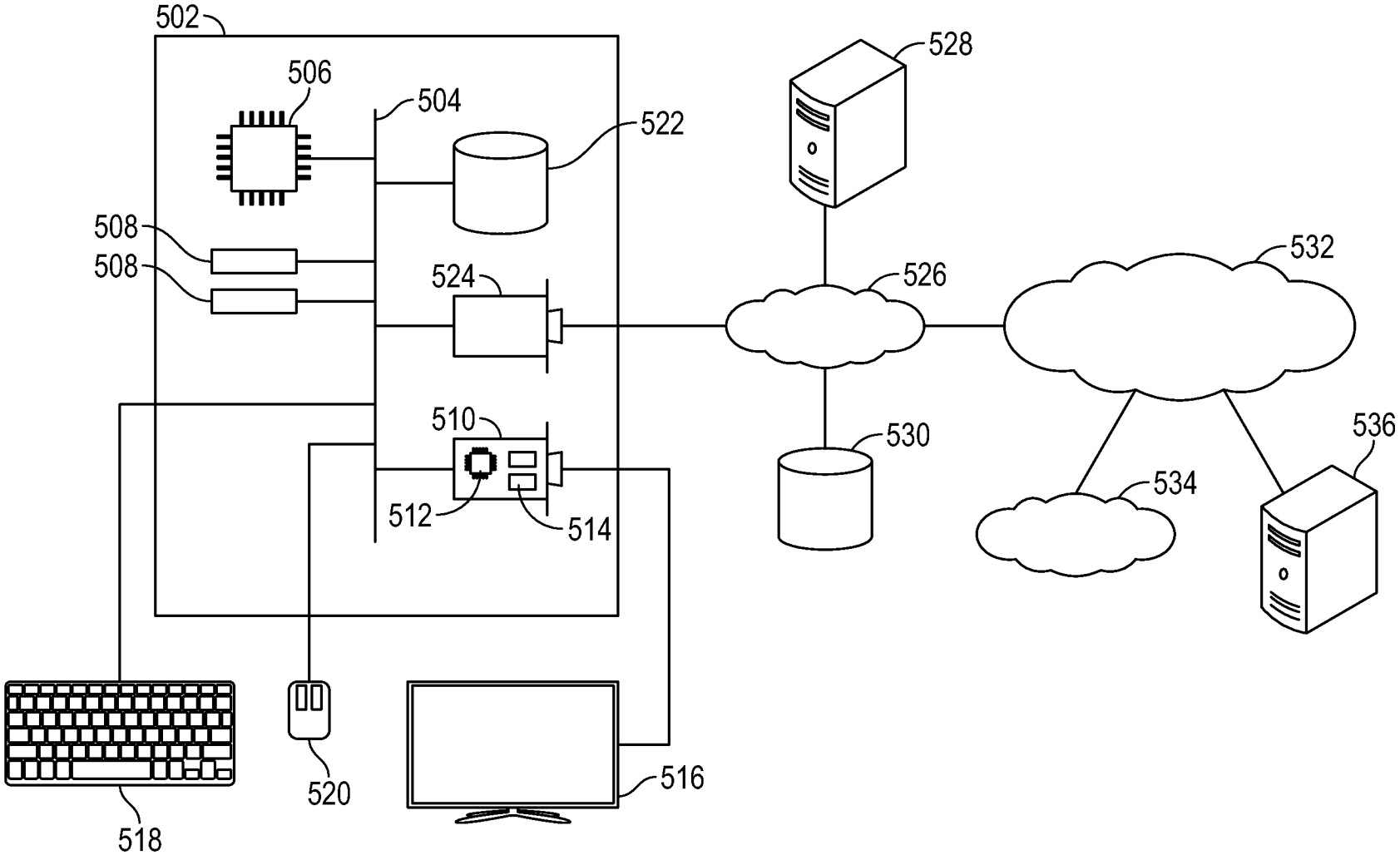
FIG. 5 depicts an exemplary hardware platform for certain embodiments of the invention.

FIG. 3 presents an exemplary flow diagram illustrating various steps of some embodiments of the invention during operation. In this example, a control system 300 is incorporated into the electrical system of a digger derrick utility vehicle 10. The control of the system may be implemented by an algorithm that receives operator inputs among other parameters to produce a certain output. The algorithm may be stored in a non-transitory computer readable media storing computer executable instructions that may be executed by a processor, such as CPU 506 of computer 502 as shown in FIG. 5, or a processor of the electronic control module 36.

At step 302, the control system 300 receives operator input as well as any other inputs or measured parameters that may be used by the system. The operator input may include a request to extend or retract the boom 15 in addition to the desired shift state of the digger assembly 22, which may include a high-speed setting or low-speed setting, as well as any other variations of speed. The state of the boom (extension or retraction), as well as the digger shift state, may be registered as variables within the control system 300. In some embodiments, the state of the digger shift hydraulic feed tube 32 may be a variable in the control system 300 or the motion state of the digger shift hydraulic feed tube 32 may correspond to the motion state of the boom 15. Additional parameters that may be used by the control system 300 may include a measured pressure from a pressure sensor within the one of the plurality of hydraulic tubes 30.

At step 304, the control system 300 checks whether the digger shift hydraulic feed tube 32 is in an extend motion state. In some embodiments, the extend motion state may be initiated by an operator input to the electronic control module 36. In certain embodiments of the invention, the control system 300 may monitor the received operator input to determine the state of the boom 15 by saving a value associated with the motion state of the boom 15 that is updated continuously, periodically, or upon each operator input. In other embodiments, the control system 300 may monitor the boom motion state by motion sensors disposed on the boom 15. The motion sensors may be linear potentiometers, accelerometers, or any other type of motion sensor. If the digger shift hydraulic feed tube 32 is in the extend motion state, the system may move on to step 308. If the digger shift hydraulic feed tube 32 is not in the extend motion state, the system may move on to step 306.

At step 306, the control system 300 checks whether the digger shift hydraulic feed tube 32 is in the retract motion state. If the digger shift hydraulic feed tube 32 is in the retract motion state, the system may move on to step 310. If the boom assembly 16 is not in the retract motion state, the system may move on to step 312. The retract motion state may be monitored in a similar fashion to that of the extend motion state according to embodiments of the invention.

At step 308, the system checks whether the digger shift state is set to a high-speed setting. In some embodiments, the shift state of the digger assembly can be one of a high-speed setting and a low-speed setting, though some embodiments may include additional speed settings. If the digger shift state is set to the high-speed setting the system may move on to step 314, otherwise, if the digger shift state is not set to the high-speed setting, the system may move on to step 318. In some embodiments, the digger shift state may be monitored according to the operator input and be saved as a variable in a memory of the control system 300, while other embodiments may actively monitor the state of the digger shift circuit via a sensor. In such embodiments, the sensor may be a pressure transducer, potentiometer, or some other sensor capable of determining the shift state of the digger.

At step 310, the system checks whether the digger shift state is set to the high-speed setting. If the digger shift state is set to the high-speed setting, the system may move on to step 316, otherwise, if the digger shift state is not set to the high-speed setting, the system may move on to step 320.

At step 312, the system checks whether the digger shift state is set to the high-speed setting. If the digger shift state is set to the high-speed setting, the system may move on to step 314, otherwise, if the digger shift state is not set to the high-speed setting, the system may move on to step 320.

At step 314, the system may set the proportional pressure reducing valve 34 to the high-pressure setting. At step 316, the system may set the proportional pressure reducing valve 34 to the Medium setting. At step 318, the system may set the proportional pressure reducing valve 34 to the low-pressure setting. At step 320, the system may set the proportional pressure reducing valve 34 to an off-pressure setting. Each setting of the proportional pressure reducing valve 34 may correspond to a specific pressure value. For example, the off-pressure setting, low-pressure setting, medium-pressure setting, and high-pressure setting may correspond to pressure values of 0 pounds per square inch (psi), 50 psi, 200 psi, and 435 psi, respectively. The values of the pressure settings may be varied in order to optimize the system for various applications.

An exemplary operation of the control system 300 of FIG. 3 that may be carried out by a processor of the electronic control module 36 will now be described. The electronic control module 36 may receive operator input at step 302. The operator input may include a request to extend the boom 15. At step 304 the system checks whether the boom 15 and the digger shift hydraulic feed tube 32 are in the extend motion state. Since the operator 14 just requested the boom extension, the boom 15 and the digger shift hydraulic feed tube 32 are in fact in the extend motion state, so the system moves to step 308. At step 308 the system checks whether the shift state of the digger assembly 22 is in the high-speed setting. Since the operator 14 has not requested the high-speed setting, the system may move on to step 318 where the proportional pressure reducing valve 34 is set to the low-pressure setting. The operator 14 may then be able to activate the digger motor 24 and begin operation of the digger assembly 22. If the operator 14 then decides to increase the digger speed to the high-speed setting, the operator 14 may give the input to the control module which may set the proportional pressure reducing valve 34 to the high-pressure setting. The shift may be carried out immediately as the digger shift hydraulic feed tube 32 of the digger shift circuit is already filled to the appropriate level and therefore, can easily translate the new pressure signal to shift the digger speed.

In some embodiments, the control system 300 may output any combination of the variables to a display. The display may be a screen disposed near the operator 14. The variables displayed on the display may include the digger shift state, boom motion state, and a pressure value within the digger shift hydraulic feed tube 32. The pressure value may be obtained by measuring the pressure of the digger shift hydraulic feed tube 32 via a pressure sensor disposed within the digger shift hydraulic feed tube 32 or at a shift cylinder within the digger assembly 22. The pressure sensor may be a hydraulic pressure transducer, piezometer, manometer, pressure transmitter, or another type of pressure sensor. In some such embodiments, multiple pressure sensors may be used, disposed at various locations within the digger shift hydraulic feed tube 32 or in other components. In some embodiments, a first pressure sensor may be disposed upstream of the proportional pressure reducing valve 34, while a second pressure sensor may be disposed downstream of the proportional pressure reducing valve. Here, the readings of the first pressure sensor and the second pressure sensor may be used to monitor the effectiveness of the proportional pressure reducing valve 34 and aid in trouble shooting the hydraulic components of the boom assembly and the digger assembly. Some embodiments may include multiple hydraulic feed tubes 30 and each hydraulic feed tube may comprise a pressure sensor, so that the pressure of each of the plurality of hydraulic feed tubes 30 may be displayed on the display. Displaying the pressure, motion state of the boom 15, and shift state of the digger assembly 22 may give feedback to the operator 14, who may be able to access various situations of the boom assembly 16 and act accordingly. The display may also aid the operator 14 in diagnosing malfunctions within the system.

In some embodiments, the proportional pressure reducing valve 34 adjusts the pressure within the variable volume of the digger shift hydraulic feed tube 32, between four discrete pressure levels that correspond to four predetermined pressure values. In other embodiments any variation of amounts of pressure values may be used, and in some cases, the pressure levels may not be discrete but be adjusted according to an analog range of pressures.

In some embodiments, the electronic control module 36 may ensure that the digger motor 24 is not activated while the digger assembly 22 is in shifting or during extension/retraction of the boom assembly 16. Since the electronic control module 36 already controls the pressure signal sent to the digger shift hydraulic circuit, the electronic control module 36 may prohibit activation of the digger motor 24 while in the shifting process to avoid damage to the gears within the gearbox 26. Additionally, the electronic control module 36 may actively monitor the pressure within the digger shift hydraulic feed tube 32 via a pressure sensor disposed within the digger shift hydraulic feed tube 32. The electronic control module 36 may disable activation of the digger motor 24 while the monitored pressure is changing and allow activation of the digger motor 24 while the pressure has become stable. The electronic control module 36 may additionally be able to disable certain other functions based on the pressure within the variable volume of the digger shift hydraulic feed tube 32.

Other embodiments of the invention may not be associated with utility vehicles having boom assemblies. The invention may be implemented into any general system that requires pressure control of a variable volume component wherein the operator 14 gives an input indicative of a change in the variable volume (e.g., increasing or decreasing) and an input indicative of a desired specific pressure within the variable volume. These alternative embodiments of the invention may be helpful to systems that require pressure signals within a variable volume space, because as the volume is changed the pressure may have to be changed accordingly to maintain pressure. These embodiments may utilize a proportional pressure reducing valve 34 to set the pressure within the variable volume according to the control system 40. The control system 300 may process inputs from an operator 14 to determine the necessary signal to send to the proportional pressure reducing valve 34 in order to maintain the desired pressure in the variable volume space.

It should be understood that the control system 300, may be used in various embodiments of the invention, such as, for example the digger derrick of FIG. 1A, and the variable volume pressure control system 70 of FIG. 2. If the control system 300 is used with the variable volume pressure control system 70 the step 308, step 310, and step 312 may be related to monitoring some parameter of the accessory device 78 rather than monitoring the digger speed. In some embodiments, step 308, step 310, and step 312 may monitor an operator input.

Figure 4:
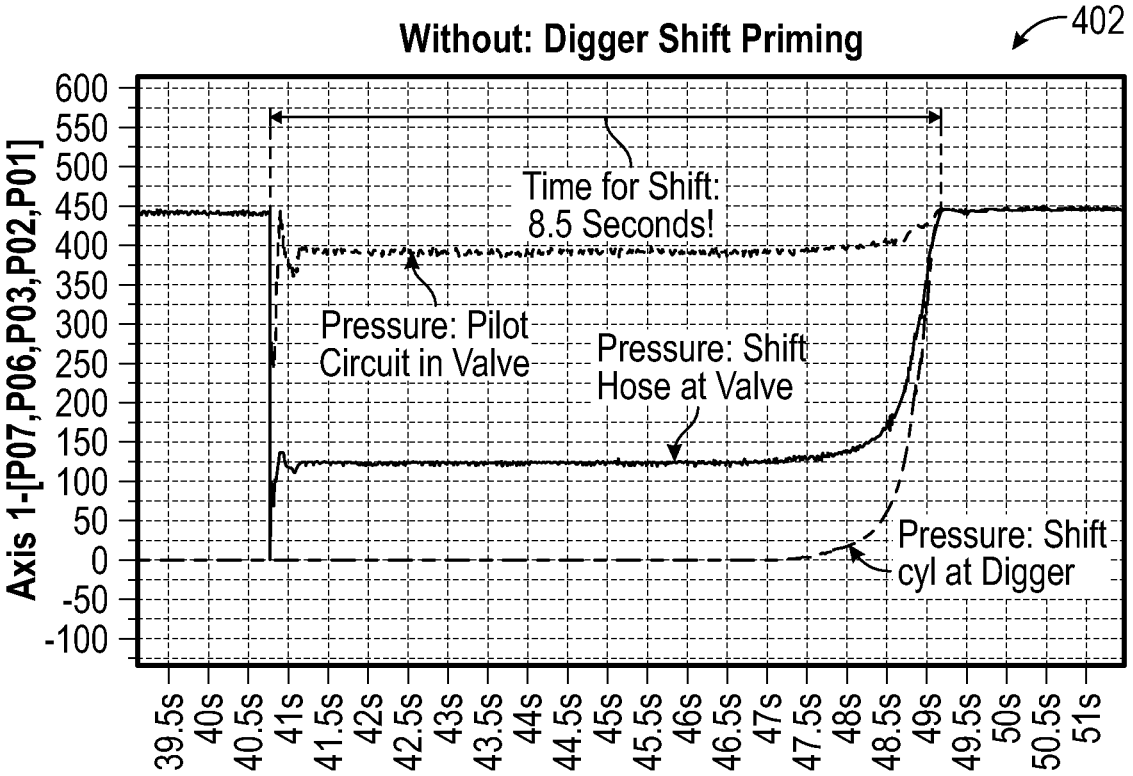
FIG. 4 is a depiction of two waveform graphs featuring experimental data that compares the time to reach a designated pressure for a digger derrick system with and without digger shift priming.
Figure 4:
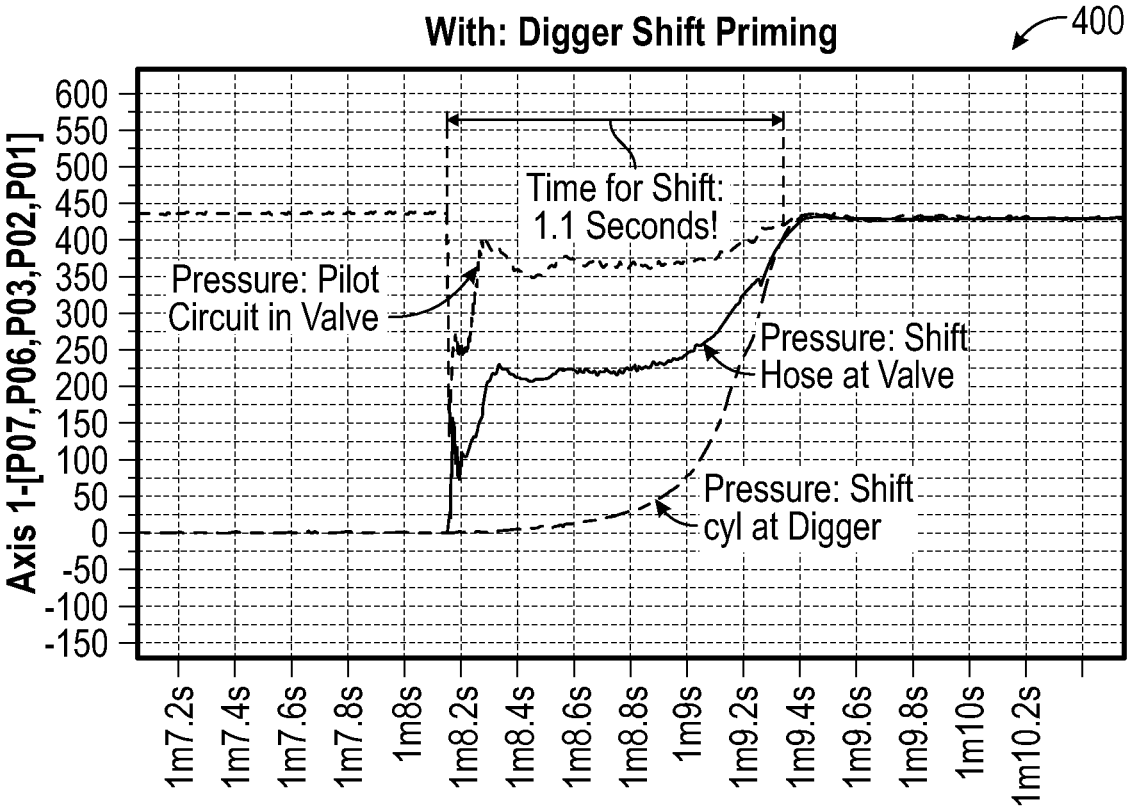

FIG. 4 depicts two graphs featuring time in seconds on the horizontal axis and pressure in psi on the vertical axis. Graph with digger shift priming 400 depicts data collected with digger shift priming and graph without digger shift priming 402 depicts data collected without digger shift priming. Each of the graphs depict pressure data collected from three positions within the digger shift hydraulic circuit: at the shift cylinder of the digger which may be disposed within the digger assembly 22 at the end of the digger shift hydraulic feed tube 32, at the shift hose of the proportional pressure reducing valve 34 disposed at the other end of the digger shift hydraulic feed tube 32 where the boom assembly 16 may be attached to the utility vehicle 10, and at a pilot circuit in the proportional pressure reducing valve 34 also disposed at the other end of the digger shift hydraulic feed tube 32 where the boom assembly 16 may be attached to the utility vehicle 10. As can be seen on the graph with digger shift priming 400, the digger derrick system with digger shift priming reached the designated pressure of around 430 psi in about 1.1 seconds. Thus, the shift of the digger assembly 22 may be completed within 2 seconds of when the input for the shift was received from the operator 14. Data recorded of the digger derrick system without digger shift priming on the graph without digger shift priming 402 shows that the digger derrick took about 8.5 seconds to reach the designated pressure. The data on the graphs is indicative of a significant improvement to the digger shift time. The reduction of shift time may lead to a reduction in operator wait time, which may in turn present an increase to available working time and gearbox lifetime based on the gearbox failure associated with premature operation while the digger is shifting.

The reason for the significant time improvement is that the invention allows the hydraulic feed tube pressure to be adjusted accordingly while the boom assembly 16 is being extended or retracted. Because the pressure can be adjusted while the boom 15 is in a motion state, by the time the boom assembly 16 has reached the specified length, the digger shift hydraulic feed tube 32 may already have the appropriate pressure (i.e., not a vacuum). As such, the proportional pressure reducing valve 34 may be operable to make slight adjustments to the pressure to shift the digger speed without having to first fill the digger shift hydraulic feed tube 32 with hydraulic fluid. In other systems, the digger shift hydraulic feed tube pressure may not be adjusted until a digger shift is requested. In certain cases, the request for a digger shift may require a relatively large pressure adjustment that is time extensive because the increased volume of the digger shift hydraulic feed tube 32 associated with an extended boom state may have to be filled. An example of the wait time for the digger shift hydraulic feed tube 32 to be filled can be seen in the graph without digger shift priming 402. The signal is received at around 40.7 seconds but the pressure change is not actually completed until around 49.5 seconds. The stagnant pressure in the shift cylinder at the digger before around 47.0 seconds is associated with the filling of the digger shift hydraulic feed tube 32. The digger shift hydraulic feed tube 32 may fill to a required amount before the pressure signal can be conveyed to the shift cylinder.

In FIG. 5, an exemplary hardware platform for certain embodiments of the invention is depicted. Computer 502 can be a desktop computer, a laptop computer, a server computer, a mobile device such as a smartphone or tablet, or any other form factor of general- or special-purpose computing device. Depicted with computer 502 are several components, for illustrative purposes. In some embodiments, certain components may be arranged differently or absent. Additional components may also be present. Included in computer 502 is system bus 504, whereby other components of computer 502 can communicate with each other. In certain embodiments, there may be multiple busses or components may communicate with each other directly. Connected to system bus 504 is central processing unit (CPU) 506. Also attached to system bus 504 are one or more random-access memory (RAM) modules 508. Also attached to system bus 504 is graphics card 510. In some embodiments, graphics card 510 may not be a physically separate card, but rather may be integrated into the motherboard or the CPU 506. In some embodiments, graphics card 510 has a separate graphics-processing unit (GPU) 512, which can be used for graphics processing or for general purpose computing (GPGPU). Also on graphics card 510 is GPU memory 514. Connected (directly or indirectly) to graphics card 510 is display 516 for user interaction. In some embodiments, no display is present, while in others it is integrated into computer 502. Similarly, peripherals such as keyboard 518 and mouse 520 are connected to system bus 504. Like display 516, these peripherals may be integrated into computer 502 or absent. Also connected to system bus 504 is local storage 522, which may be any form of computer-readable media, and may be internally installed in computer 502 or externally and removeably attached.

Computer-readable media include both volatile and nonvolatile media, removable and nonremovable media, and contemplate media readable by a database. For example, computer-readable media include (but are not limited to) RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data temporarily or permanently. However, unless explicitly specified otherwise, the term "computer-readable media" should not be construed to include physical, but transitory, forms of signal transmission such as radio broadcasts, electrical signals through a wire, or light pulses through a fiber-optic cable. Examples of stored information include computer-usable instructions, data structures, program modules, and other data representations.

Finally, network interface card (NIC) 524 is also attached to system bus 504 and allows computer 502 to communicate over a network such as network 526. NIC 524 can be any form of network interface known in the art, such as Ethernet, ATM, fiber, Bluetooth, or Wi-Fi (i.e., the IEEE 802.11 family of standards). NIC 524 connects computer 502 to local network 526, which may also include one or more other computers, such as computer 528, and network storage, such as data store 530. Generally, a data store such as data store 530 may be any repository from which information can be stored and retrieved as needed. Examples of data stores include relational or object oriented databases, spreadsheets, file systems, flat files, directory services such as LDAP and Active Directory, or email storage systems. A data store may be accessible via a complex API (such as, for example, Structured Query Language), a simple API providing only read, write and seek operations, or any level of complexity in between. Some data stores may additionally provide management functions for data sets stored therein such as backup or versioning. Data stores can be local to a single computer such as computer 528, accessible on a local network such as local network 526, or remotely accessible over Internet 532. Local network 526 is in turn connected to Internet 532, which connects many networks such as local network 526, remote network 534 or directly attached computers such as computer 536. In some embodiments, computer 502 can itself be directly connected to Internet 532.

In some embodiments, computer 502 may be interfaced with electronic control module 36, as shown in FIGS. 1A-B, and 3. Further, in some embodiments, computer 502 may be electronic control module 36. In such embodiments, the control system 300 of FIG. 3 may be executed by the CPU 506 of computer 502. Similarly, in some embodiments, an algorithm for performing the operations of control system 300 may be stored on local storage 522 of computer 502.

In addition to boom assemblies having digger assemblies, embodiments of the invention may be integrated into boom assemblies having other accessory devices, such as, for example, grapple saws, or aerial devices. A boom assembly having a grapple saw may have a similar issue as seen with shifting the digger speed. The grapple saw may comprise a component which requires a pressure signal passed through a hydraulic feed tube that runs along the boom 15. For example, the component may be a shifting mechanism of the grapple saw to shift the speed of the saw. When the boom 15 is extended or retracted the volume of the hydraulic feed tube is increased or decreased, respectively. As with the digger derrick, the pressure of the variable volume of the hydraulic feed tube may change as the volume changes, so a system to maintain the hydraulic feed tube pressure would be helpful for grapple saw components as well. In the case of aerial devices, an aerial device may be attached to the end of a boom 15 and comprise a platform, on which an operator 14 may be positioned. The operator 14 may use tools that run on hydraulic power from the aerial device which is supplied via a hydraulic feed tube running along the length of the boom 15. Similar to the previously described scenarios, extension or retraction of the boom 15 may inadvertently affect the pressure within the hydraulic feed tube, so a system may be necessary to maintain and control the pressure within the hydraulic feed tube during a motion state of the boom 15. Some embodiments of the invention maintain the hydraulic feed tube pressure, so the operator 14 may use the tools on the aerial device directly after the boom 15 is extended or retracted, because the hydraulic feed tube may already be filled to the appropriate level.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A system for controlling a hydraulic pressure of a boom assembly having a boom, said boom having a proximal end and a distal end, the system comprising:

a hydraulic feed tube disposed within the boom with a first end of the hydraulic feed tube at the proximal end of the boom and a second end of the hydraulic feed tube at the distal end of the boom, wherein the hydraulic feed tube has a variable volume that changes according to a motion state of the hydraulic feed tube, wherein the motion state of the hydraulic feed tube is based on a first operator input;

a control module;

a pressure valve disposed at the first end of the hydraulic feed tube; and a digger assembly secured to the distal end of the boom, the digger assembly comprising:

a digger motor;

a gearbox disposed proximate to the digger motor to translate rotational motion of the digger motor to a driven shaft; and an auger secured to the driven shaft, wherein a pressure within the variable volume is associated with a shift state of the digger assembly, wherein the shift state of the digger assembly is based on a second operator input, wherein the control module is programmed to control the pressure valve to adjust the pressure within the variable volume of the hydraulic feed tube according to the motion state of the hydraulic feed tube and the shift state of the digger assembly, wherein the pressure within the variable volume of the hydraulic feed tube is adjusted while the variable volume is changing.

2. The system of claim 1, wherein the shift state of the digger assembly is one of high speed setting and a low speed setting, wherein a high value of the pressure in the variable volume of the hydraulic tube is associated with the high speed setting and a low value of the pressure in the variable volume of the hydraulic tube is associated with the low speed setting.

3. The system of claim 1, wherein the hydraulic feed tube is filled with a hydraulic fluid before the second operator input is received.

4. The system of claim 1, wherein the control module monitors the pressure within the variable volume via a pressure sensor disposed within the hydraulic feed tube, wherein the control module disables activation of the digger motor while the pressure within the variable volume is changing.

5. The system of claim 1, wherein the pressure valve adjusts the pressure within the variable volume between four discrete pressure levels.

6. The system of claim 1, wherein the pressure valve is an electro-proportional pressure reducing valve.

7. The system of claim 1, wherein the control module is programmed to control the adjustment of the pressure valve to:

automatically add pressure to the variable volume when the variable volume of the hydraulic feed tube is increasing; and automatically subtract pressure from the variable volume when the variable volume of the hydraulic feed tube is decreasing.

8. A method for maintaining a pressure within a hydraulic feed tube of a boom assembly comprising the steps of:

receiving, from an operator, a first input associated with a motion state of the hydraulic feed tube, wherein a variable volume of the hydraulic feed tube changes according to the motion state of the hydraulic feed tube;

receiving, from the operator, a second input associated with the pressure;

adjusting a pressure valve according to the motion state of the hydraulic feed tube to maintain the pressure within the variable volume while the variable volume is changing; and continuously updating a command to control the adjustment of the pressure valve based at least in part on the first operator input and the second operator input.

9. The method of claim 8, further comprising the step of monitoring the pressure within the variable volume via a pressure sensor disposed within the hydraulic feed tube, wherein at least one function is disabled based at least in part on the pressure within the variable volume.

10. The method of claim 8, wherein the pressure within the variable volume is adjusted between four discrete pressure levels.

11. The method of claim 8, wherein the pressure valve is an electro-proportional pressure reducing valve.

12. The method of claim 8, further comprising the steps of:

adjusting the pressure valve to automatically add pressure to the variable volume when the variable volume of the hydraulic feed tube is increasing; and adjusting the pressure valve to automatically subtract pressure from the variable volume when the variable volume of the hydraulic feed tube is decreasing.

13. The method of claim 8, wherein a distal end of the boom assembly is attached to a digger assembly comprising a digger motor, an auger, and a gearbox, wherein the digger assembly requires the pressure be maintained within the variable volume to initiate a shift of the digger assembly.

14. The method of claim 13, wherein the hydraulic feed tube is filled with a hydraulic fluid before an operator input for a shift of the digger assembly is received.

15. The method of claim 13, wherein the shift state of the digger assembly is one of two settings further comprising the step of, adjusting the pressure valve to a high pressure setting when the hydraulic feed tube is in an extend motion state and the digger assembly is in a high speed shift state.

16. One or more non-transitory computer readable media storing computer-executable instructions that, when executed by a processor, perform a method of maintaining a pressure within a hydraulic feed tube comprising the steps of:

receiving, from an operator, a first input associated with a motion state of the hydraulic feed tube, wherein a variable volume of the hydraulic feed tube is changed according to the motion state of the hydraulic feed tube;

receiving, from an operator, a second input associated with the pressure;

adjusting a pressure valve according to the motion state of the hydraulic feed tube to maintain the pressure within the variable volume while the variable volume is changing; and continuously updating a command to control the adjustment of the pressure valve based at least in part on the first input and the second input.

17. The method of claim 16, further comprising the step of monitoring the pressure within the variable volume via a pressure sensor disposed within the hydraulic feed tube, wherein at least one function is disabled based at least in part on the pressure within the variable volume.

18. The method of claim 16, wherein the pressure within the variable volume is adjusted between four discrete pressure levels.

19. The method of claim 16, wherein the pressure valve is an electro-proportional pressure reducing valve.

20. The method of claim 16, further comprising the steps of adjusting the pressure valve to:

automatically add pressure to the variable volume when the variable volume of the hydraulic feed tube is increasing; and automatically subtract pressure from the variable volume when the variable volume of the hydraulic feed tube is decreasing.

* * * * *